US005810177A

United States Patent [19]

Cabiran

[11] Patent Number: 5,810,177

[45] Date of Patent: Sep. 22, 1998

[54] VERSATILE TOOL RACK ASSEMBLY

[76] Inventor: Michel Lewis Cabiran, 919 Ashby Dr., Allen, Tex. 75002

[21] Appl. No.: 386,277

[22] Filed: Feb. 9, 1995

[51] Int. Cl.[6] ..... A47F 7/180

[52] U.S. Cl. ..... 211/70.6; 211/90

[58] Field of Search ..... 211/70.6, 60.1, 211/62, 63, 64, 65, 66, 70.1, 70.2, 70.8, 187, 90, 87; 206/349, 361; 224/904; 108/42, 48; 411/180, 181

[56] References Cited

U.S. PATENT DOCUMENTS

| | | | |
|---|---|---|---|
| 226,891 | 4/1880 | Tym | 211/65 X |
| D. 294,548 | 3/1988 | Wallace | D6/567 |
| 326,193 | 9/1885 | Barber | 211/63 |
| 418,435 | 12/1889 | Besse . | |
| 877,145 | 1/1908 | Waddell | 47/41.13 |
| 1,109,788 | 9/1914 | Rose | 211/62 |
| 1,336,973 | 4/1920 | Levene | 211/135 X |
| 1,538,849 | 5/1925 | Eger | 211/70.6 |
| 1,733,868 | 10/1929 | Durell | 211/70.6 |
| 1,915,020 | 6/1933 | Goldstein | 211/63 |
| 2,587,226 | 2/1952 | Rodman | 211/65 |
| 2,745,558 | 5/1956 | Greenspan | 211/60.1 |
| 2,815,863 | 12/1957 | Larson | 211/70.1 |
| 2,835,503 | 5/1958 | Humphries et al. | 211/70.6 X |
| 2,854,147 | 9/1958 | Derr | 211/70.8 |
| 3,000,420 | 9/1961 | Spokes | 411/180 |
| 3,145,031 | 8/1964 | Wilkinson | 280/47.35 |
| 3,298,531 | 1/1967 | Wilcke | 211/70.6 |
| 3,298,532 | 1/1967 | Wilcke | 211/60 |
| 3,532,221 | 10/1970 | Kaluhiokalani | 211/60 |
| 3,604,566 | 9/1971 | Rem | 211/74 |
| 3,759,538 | 9/1973 | Fabiano | 211/70.6 X |
| 3,819,034 | 6/1974 | Clark | 211/65 |
| 3,905,483 | 9/1975 | Patrick | 211/177 |
| 4,056,220 | 11/1977 | Trimble | 211/70.5 X |
| 4,098,481 | 7/1978 | Johnson et al. | 211/90 X |
| 4,634,010 | 1/1987 | Otema | 211/90 X |
| 4,641,755 | 2/1987 | Oliver | 211/60.1 |
| 4,742,782 | 5/1988 | Miller | 211/187 |
| 4,760,800 | 8/1988 | Hanson | 108/42 X |
| 4,947,998 | 8/1990 | Smeller | 211/70.6 |
| 4,955,490 | 9/1990 | Schäfer | 211/187 |
| 5,011,028 | 4/1991 | Sweeney | 211/60.1 |
| 5,092,463 | 3/1992 | Dees | 206/373 |
| 5,279,430 | 1/1994 | Benton | 211/151 |
| 5,408,936 | 4/1995 | Tseng | 211/90 X |
| 5,433,322 | 7/1995 | Williams | 211/60.1 X |
| 5,495,954 | 3/1996 | Schmidt | 211/187 X |
| 5,505,318 | 4/1996 | Goff | 211/90 |
| 5,540,339 | 7/1996 | Lerman | 211/87 X |

*Primary Examiner*—Alvin C. Chin-Shue

[57] ABSTRACT

A versatile tool rack assembly for holding, organizing, or displaying garden tools, house cleaning tools, home supplies, etc. with elongated shapes made of two or more rack pans (50, 52) each supported at all corners with pan support beams (14) with multiple mounting holes (24) for adjustment of the spacing of the rack pans. Rack pans are usually identical and are generally attached to the pan support beams with assembly bolts (18) and assembly nuts (42) or captured nuts (46). Rack assemblies may be attached to a wall, floor, ceiling, post, base, workbench, etc. or another rack assembly.

8 Claims, 7 Drawing Sheets

22

28
26
34
50
30
32
32
40
24
14
16
16
34
2
2
3
3
52
18
48
20

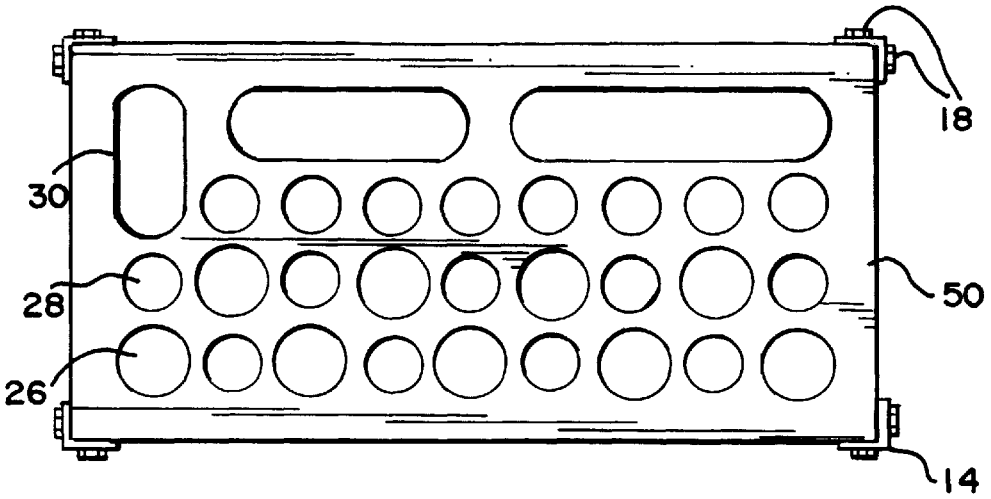
Fig. 6
Fig. 7
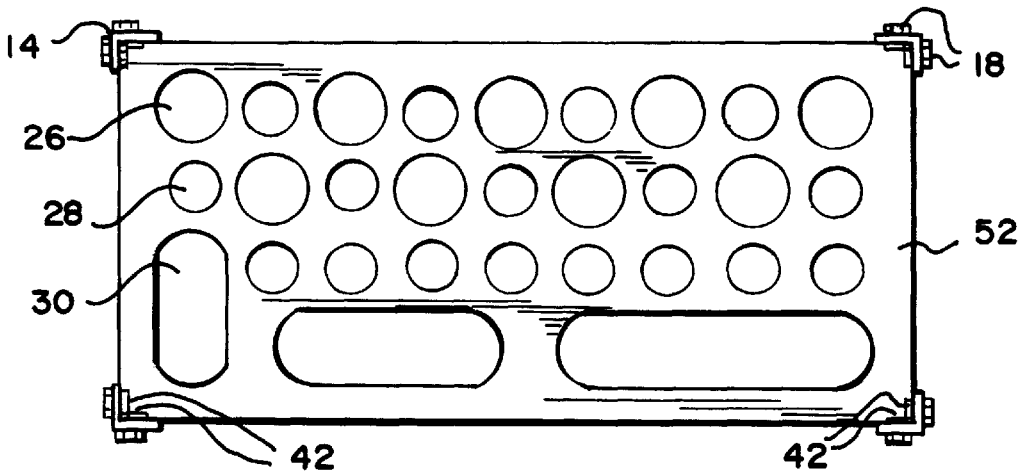

VERSATILE TOOL RACK ASSEMBLY

BACKGROUND OF THE INVENTION

1. Field of the Invention

This invention relates to tool racks, specifically special article tool racks which are used to support and organize home and garden tools with long handles, and elongated home supplies such as pipe, molding, etc.

2. Description of the Related Art

Most households have a variety of long tools used to sweep, mop, and wax the floor. If the house has its own backyard there are long tools to rake the grass, dig post holes, and other tools with elongated handles. There may also be other long items such as spare pipe, molding, dowels, bars, etc.

These items are too long to fit into a drawer and might be stood on end in a corner. Other ways to store these items are to hang them on a wall rack, from a nail, or simply lay them on the floor.

If the items are stood on end in a corner, the rakes and brooms will not fit well. If there are many items they will look messy and may fall and hurt someone. Also, to get an item at the bottom of the pile one needs to disassemble then reassemble the whole pile.

The same problems arise when a pile of tools is put on the floor except they won't fall.

One may attempt to hang these items from hooks or supports on the wall or ceiling. Again, one of the problems is that items may fall from the wall or ceiling. Another problem is that some items like pipe, dowels, molding, etc. do not have anything like a hole to hold them on a hook, or a bulge to hold them between supports.

To remedy this Inventors have created many types of tool racks to help hold, store, and/or display garden tools and the like.

U.S. Pat. No. 418,435 to Besse (1889), a Display Rack for Tools, was one of the first inventions to do this. This rack holds relatively few tools, its top and bottom racks are not adjustable, and it is not designed to take advantage of the latest mass production techniques.

U.S. Pat. No. 1,915,020 to Goldstein (1933) shows an Umbrella Holder with one edge of the support pans attached to a sturdy frame. It also uses aligned holes to support elongated articles.

U.S. Pat. No. 2,815,863 to Larsen (1957), A Garden Tool Stand, is designed so that it can be stamped out of sheet metal and mass produced. This stand depends upon a solid wall for complete support of one side of the stand, and does not have any separate vertical support on the side opposite to the wall.

U.S. Pat. No. 3,145,031 to Wilkinson (1964) shows a Mobile Tool Supporting Apparatus which is self supporting. It includes wheels which makes it portable.

U.S. Pat. No. 3,298,531 to Wilcke (1967), Devices For Storing Tools And The Like, seems to be a sturdier rack than the one by Larsen but it still depends upon a very solid wall mount along an edge for support. Optimum support would be difficult against a single post or stud.

U.S. Pat. No. 3,298,532 to Wilcke (1967), Device For Storing Articles, shows a portable rack for elongated tools which can stand upright on its own if the rack and tools remain balanced.

U.S. Pat. No. 3,759,538 to Fabiano (1973) shows a Garden Kaddy which is similar to the patent by Wilkinson except that it appears more stable as drawn.

U.S. Pat. No. 3,819,034 to Clark (1974) shows a Shipping and Display Arrangement for Brooms which is one of many box assemblies with support holes for displaying tubular merchandise, brushes, and the like. These are generally free standing and temporary since they are made of corrugated paper.

U.S. Pat. No. 4,742,782 to Miller (1988) shows a Sheet Metal Shelving Assembly which is self supporting or may be screwed to the wall. The height of the shelves may be adjusted by selecting different sets of screw holes in the supporting legs. Although this is not a rack for holding elongated tools and supplies it shows a common method of using a series of holes in parallel supports to make planar surfaces adjustable with respect to the base and each other.

U.S. Pat. No. 5,011,028 to Sweeney (1991) shows an Adjustable Arrow Holder with a means of vertically adjusting the horizontal racks. This means is four threaded vertical rods with two nuts on each end of each rod. These two nuts capture the horizontal rack at any desired vertical position if the rod is fully threaded.

These patents listed in the background are incorporated by reference herein.

SUMMARY OF THE INVENTION

In one respect the present invention comprises two or more planar surfaces called rack pans, with tool cutouts in each surface which line up with each other when assembled parallel to each other. These rack pans are supported by a plurality of pan support beams with multiple holes along their length to facilitate adjustment of the rack pans with respect to each other and other surfaces. Tools and supplies are placed in and supported by the aligned tool cutouts.

In another respect the present invention comprises an assembly of two substantially planar polygonal rack pans with cutouts in each for holding elongated tools, with corner regions with at least one pan assembly hole at each corner region whose centerline is substantially parallel to the polygonal plane, supported at each corner region by pan support beams with mounting holes, means for attaching those pan support beams to corresponding corner regions of each rack pan, and means of attaching the assembly to supporting surfaces.

In another respect the present invention comprises a first rack pan having a substantially planar polygonal surface, a plurality of substantially planar side surfaces which depend angularly from respective edges of the first polygonal surface, a plurality of tool cutouts defined within the first polygonal surface, and a plurality of corner regions defined by adjacent side surfaces, a second rack pan substantially similar to the first, a plurality of pan support beams extending parallel to each other, means for connecting each of the pan support beams with a respective one of the corner regions of the first and second rack pans spacing the pans apart, a supporting surface extending parallel to the support beams, and means for securing at least one of the support beams to the supporting surface.

Some of the objects and advantages of the present invention in combination is that it is:

(a) Simple—Made of only five or six different parts in typical embodiment. Easy to assemble.

(b) Inexpensive—Cheap to manufacture.

(c) Sturdy—Free standing, but when stabilized horizontally against a wall, stud, post, and floor will hold the heaviest house and garden tools and supplies.

(d) Easy to Position and Fasten—One only needs to line it up with a solid wall, stud, or post then fasten it at two places for it to be stable on the floor against the wall, stud, or post.

(e) Compact—Able to be fit into a small box when disassembled. Able to store a lot of tools in a small area when assembled.

(f) Very stable once screwed to a support.

(g) Adjustable—Able to vary relative distance of rack pans to get optimum utility.

(h) Easy to organize tools in a neat array.

(i) Versatile—Able to mount tools in various ways such as vertically against the wall, horizontally against the wall, or overhead to save space and increase convenience.

(j) Easy to mass produce—There is only one novel part which needs to be manufactured and this part can be made economically in large or small numbers.

(k) Lightweight—Typically made of light gage sheet metal or plastic.

(l) Corrosion resistant—Typically made of galvanized or coated sheet metal or plastic.

It will be seen that this Versatile Tool Rack Assembly can be used to hold, store, or display a variety of tools or supplies in several positions so they may be organized in a compact manner and removed easily and conveniently.

BRIEF DESCRIPTION OF THE DRAWINGS

FIG. 6 shows a top plan view of the rack assembly.

FIG. 7 shows a bottom plan view of the rack assembly.

Reference Numerals in Drawings

| | |
|---|---|
| 14 pan support beam | 16 fastener |
| 18 assembly bolt | 20 floor |
| 22 supporting surface | 24 mounting hole |
| 26 large tool cutout | 28 small tool cutout |
| 30 irregular tool cutout | 32 pan support hole |
| 34 protective stripping | 36 right angle connector |
| 38 base fastener | 40 pan assembly hole |
| 42 assembly nut | 44 washer |
| 46 captured nut | 48 tool or supply |
| 50 first rack pan | 52 second rack pan |
| 54 shelf | 56 base |
| 58 gusset | |

DESCRIPTION OF THE PREFERRED EMBODIMENTS

Figure 1:
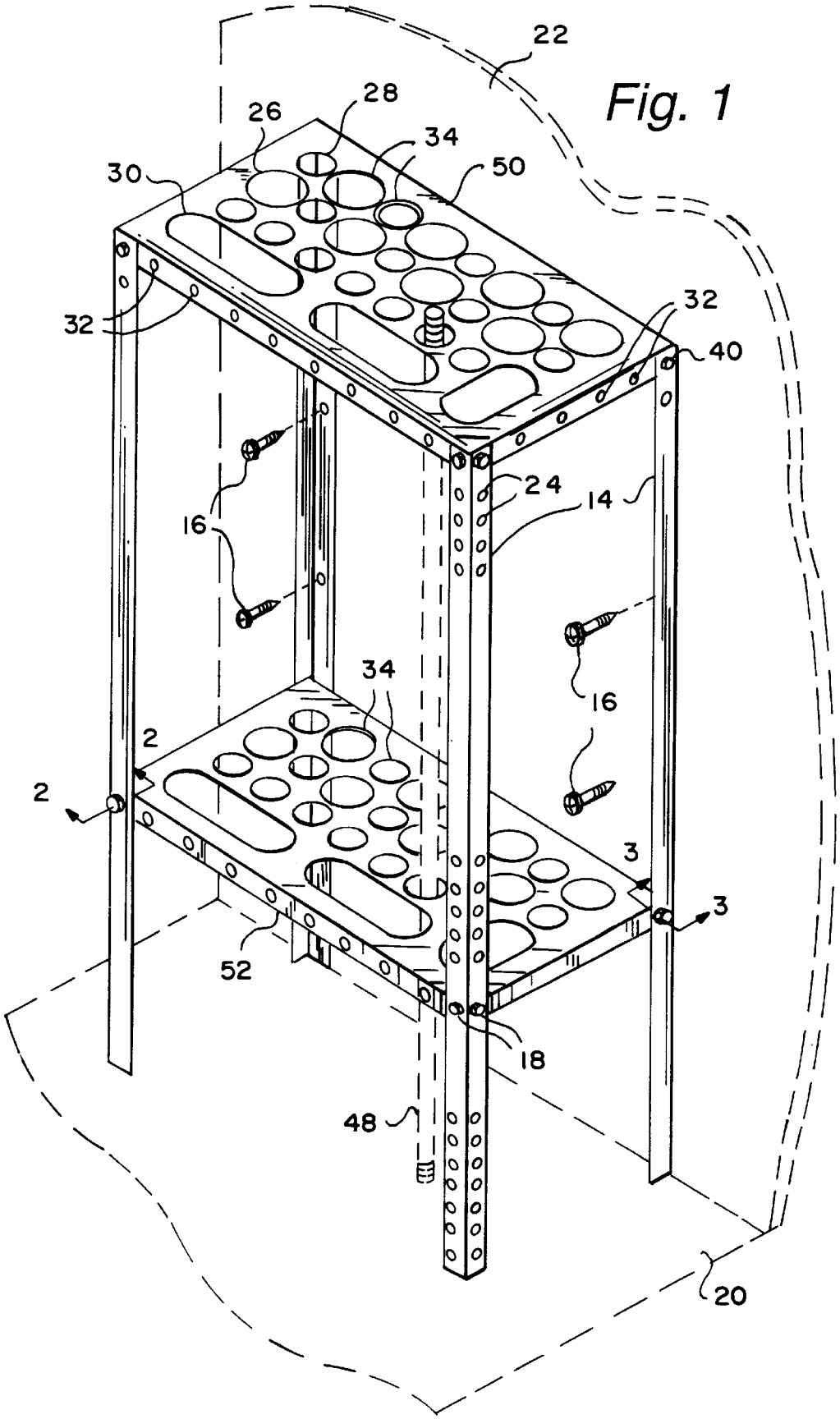
FIG. 1 shows an isometric drawing of the rack assembly with a supply and how it mounts onto the supporting surface and floor.
Figure 2:
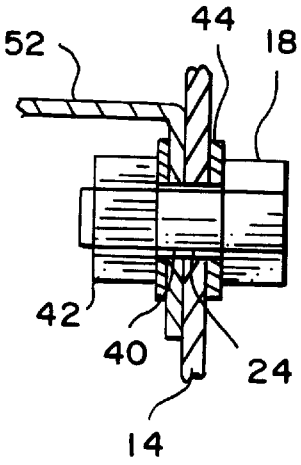
FIG. 2 shows a cross-sectional view of a nut, bolt, and washer method of connection.

FIG. 1 is an isometric drawing of a preferred embodiment of the Versatile Tool Rack Assembly. The tool rack assembly (a surface mounted rack) is made up of a first rack pan (a planar first polygonal surface with a plurality of planar side surfaces) 50 similar to a second rack pan (a planar second polygonal surface with a plurality of planar side surfaces) 52 positioned at their corner regions on four pan support beams (elongate angle-iron members) 14 to hold tools or supplies 48 vertically. Tool cutouts 26, 28, 30 are lined up with each other vertically. Spacing of the first rack pan and second rack pan is adjusted to the most useful distance with the many equally spaced mounting holes 24. Assembly bolts 18, washers 44, and assembly nuts 42 attach the first rack pan and second rack pan to the pan support beams. A typical means of attachment is shown in FIG. 2 and described in detail the next paragraph. A fastener 16 goes through a mounting hole and/or pan support hole 32 at a place where the fastener intersects a vertical supporting surface 22 such as a wall. The bottoms of the pan support beams rest on the floor 20 enabling the first rack pan and second rack pans to support heavy tools or supplies. Protective stripping 34 is used to prevent marring of the tool handles or supplies.

FIG. 2 is a cross-sectional view drawing of a means of attachment which details how to use an assembly nut, assembly bolt, and two washers to attach the rack pan to the pan support beam. The bolt goes through the washer, then the mounting hole, then a pan assembly hole 40, then another washer, then is tightened with the assembly nut. Another method to attach the rack pan to the pan support beam is shown in FIG. 3 and described in the next paragraph.

Figure 3:
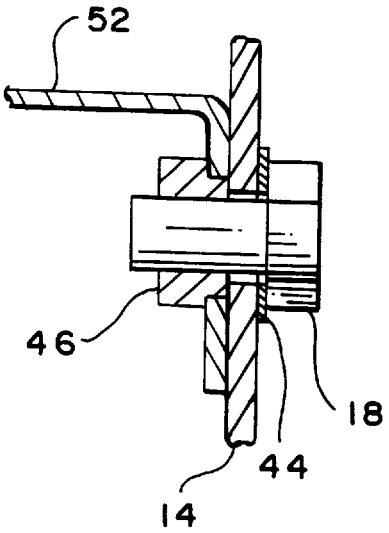
FIG. 3 shows a cross-sectional view of a captured nut, bolt, and washer method of connection.

FIG. 3 is a cross-sectional view of an alternate means of attachment which shows the rack pan attached to the pan support beam with the aid of the assembly bolt, the washer, and a captured nut, 46. A captured nut is simply a nut previously attached to the rack pan. The assembly bolt goes through the washer then the mounting hole then into the captured nut end is tightened.

Figure 4:
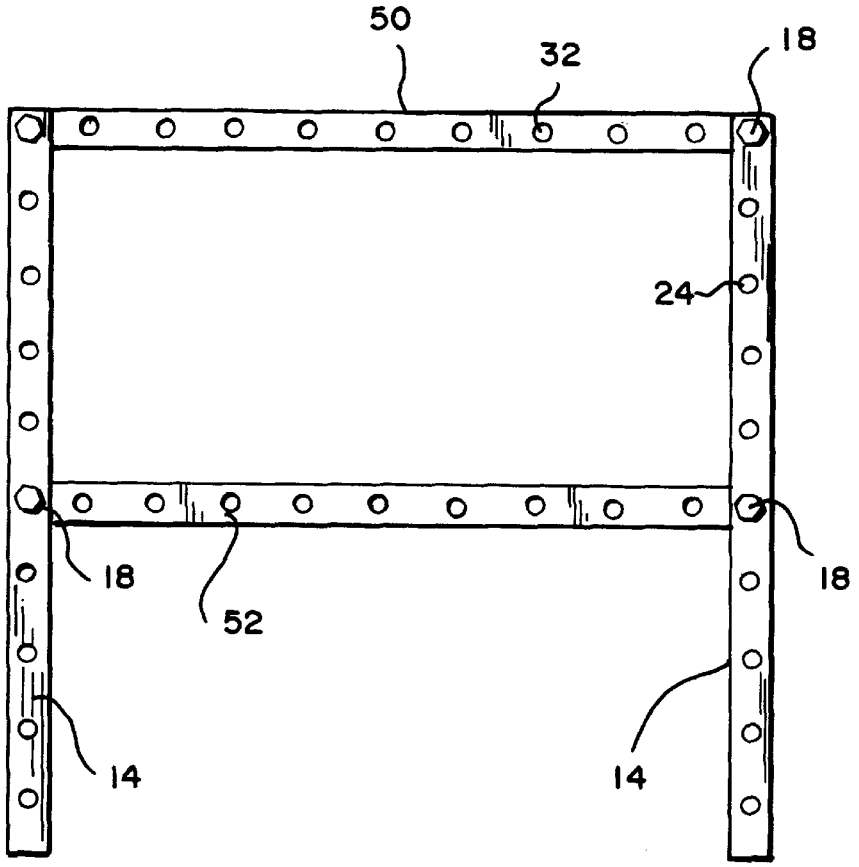
FIG. 4 shows a front elevational view of the rack assembly.

FIG. 4 is a front elevational view of the tool rack assembly. The back view of the tool rack assembly is substantially the same as the front. It shows the first rack pan and the second rack pan being supported by two pan support beams with the aid of assembly bolts and assembly nuts (not shown) through mounting holes and pan assembly holes (not shown).

Figure 5:
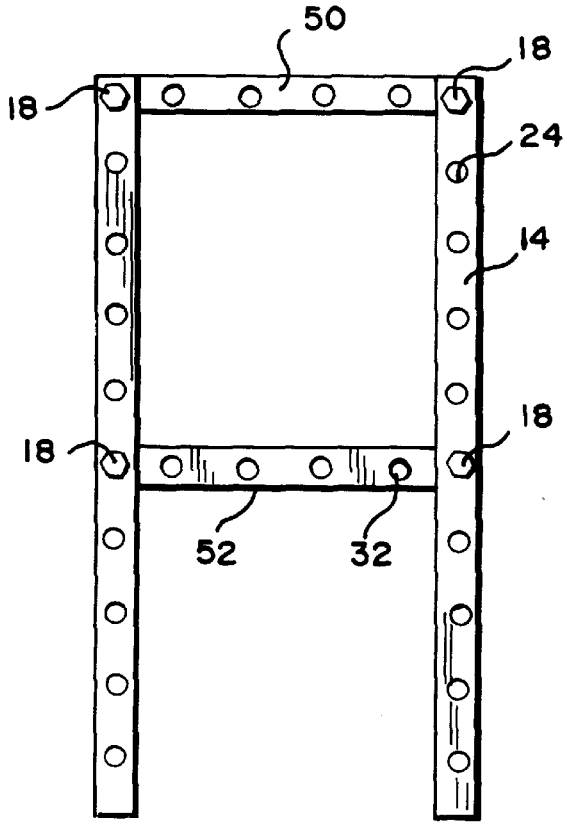
FIG. 5 shows a left side elevational view of the rack assembly.

FIG. 5 is a left side elevational view of the tool rack assembly. The right side view of the tool rack assembly is substantially the same as the left side. It shows the first rack pan and the second rack pan being supported by two pan support beams with the aid of assembly bolts and assembly nuts (not shown) through mounting holes and pan assembly holes (not shown).

FIG. 6 is a top plan view of the tool rack assembly. It shows the first rack pan and four pan support beams from the top. It shows the assembly bolts used to attach the first rack pan to the four pan support beams. It also shows a small tool cutout, a large tool cutout and an irregular tool cutout.

FIG. 7 is a bottom plan view of the tool rack assembly. It shows the second rack pan attached to four pan support beams with the aid of assembly bolts and assembly nuts through mounting holes (not shown) and pan assembly holes (not shown).

Figure 8:
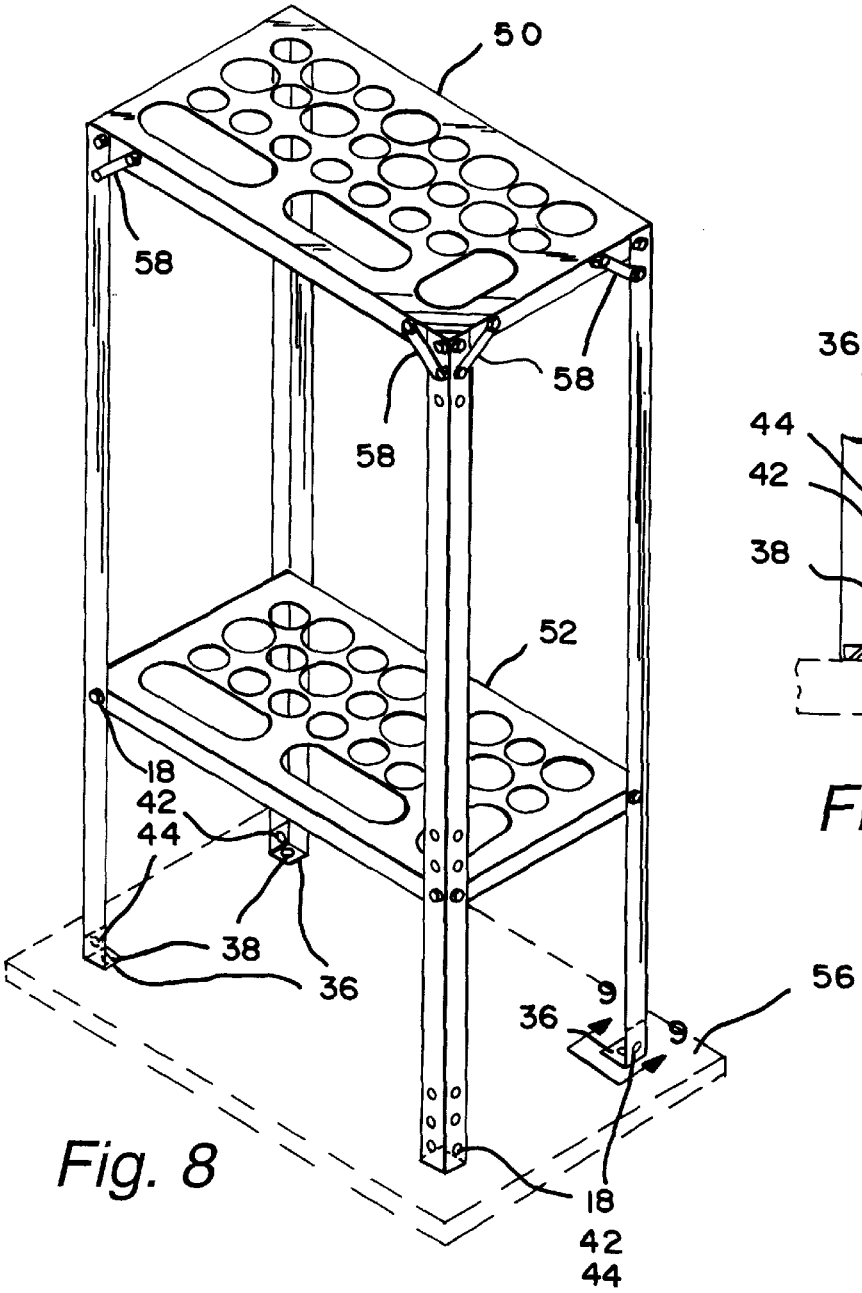
FIG. 8 shows an isometric drawing of the rack assembly mounted on a base with gussets attached to the upper corners.

FIG. 8 is an isometric drawing of the tool rack assembly mounted only on a base 56. It shows the first rack pan and the second rack pan being supported by four pan support beams with the aid of assembly bolts and nuts (not shown) through mounting holes and pan assembly holes (not shown). It shows how the tool rack assembly is attached to the base with the aid of right angle connector 36 and base fasteners 38. This is shown in more detail in FIG. 9 and described in the next paragraph. It also shows strap type gussets fastened at two points near the upper corners to stiffen the assembly.

Figure 9:
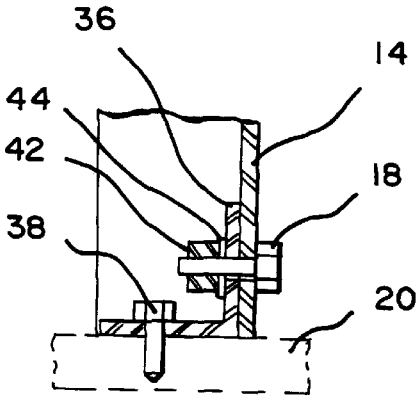
FIG. 9 shows a cross-sectional view of the attachment method of the bottom of the rack assembly.

FIG. 9 is a cross-sectional view of the connection at the base of the pan support beams. It shows the bottom of a pan support beam attached to a right angle connector with an assembly nut and bolt, which in turn is attached to the base with a screw, anchoring the right angle connector and the pan support beam to the base.

Figure 10:
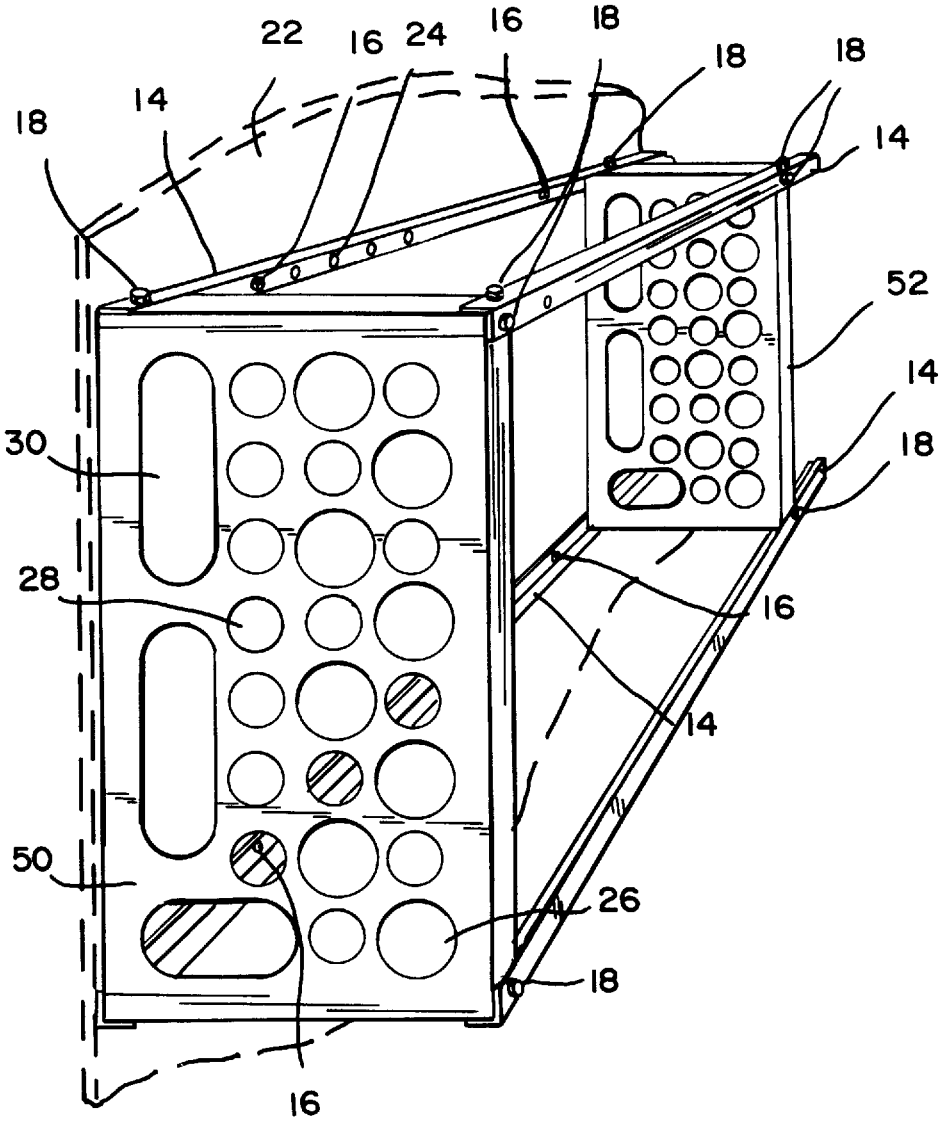
FIG. 10 shows a perspective view of the rack mounted on a vertical or overhead supporting surface.

FIG. 10 is a perspective view of the tool rack assembly mounted horizontally on a sturdy vertical or overhead supporting surface. It shows the first and second rack pans attached to four pan support beams with assembly nuts and bolts. It shows the entire tool rack assembly attached to the supporting surface with four fasteners going through four mounting holes in two pan support beams. Tools and supplies can then be placed horizontally through corresponding tool cutouts.

Figure 11:
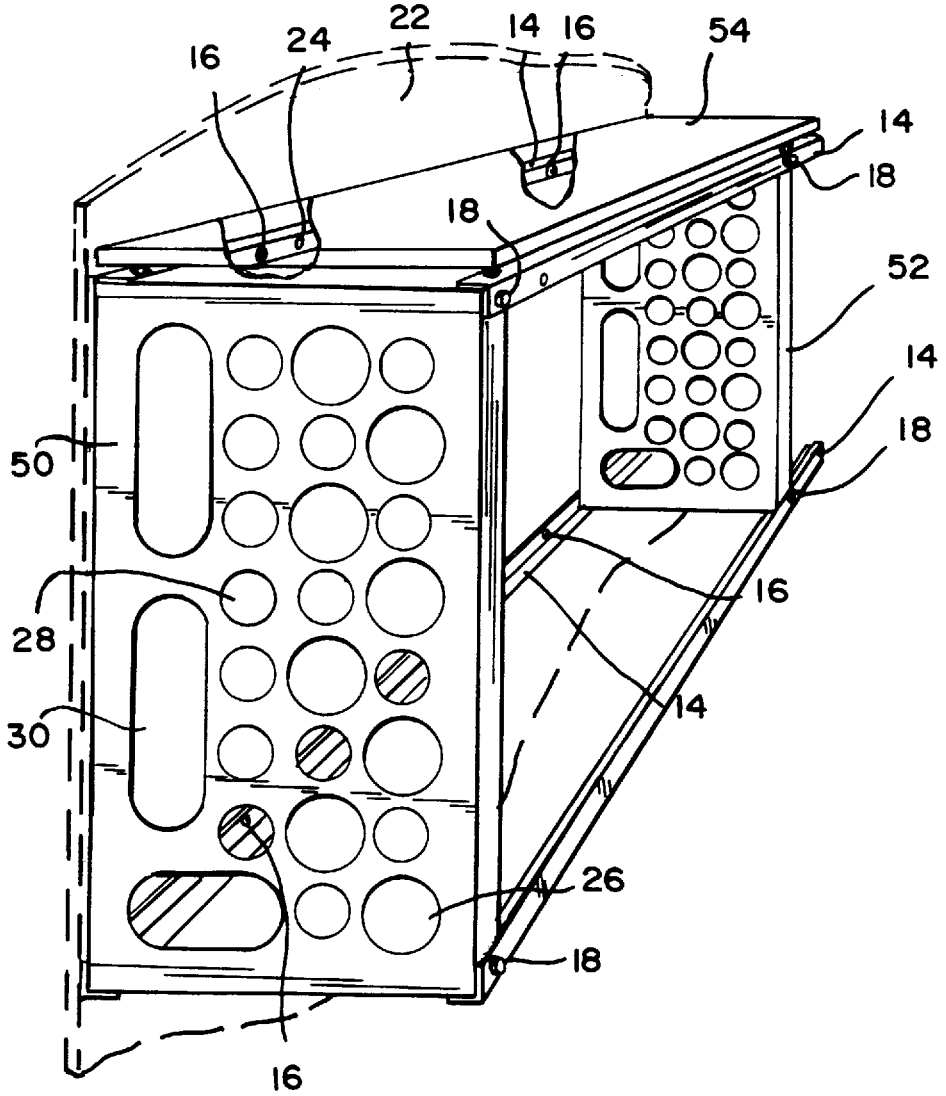
FIG. 11 shows a perspective view of the rack mounted on a vertical supporting surface with a shelf mounted on top of it.

FIG. 11 is a perspective view of the tool rack assembly mounted horizontally on a sturdy vertical supporting surface with a shelf mounted on top of it. The shelf as shown is not be attached to the rack. The shelf is used to hold other supplies such as dustpan and brush, bucket, sprayers, clippers, or other items which will not fit into the rack cutouts.

Additional methods of supporting and using the tool rack assembly are as follows:

1. Tool Rack Assembly is mounted under a work bench and tools are supported horizontally.
2. A smaller version of a Tool Rack Assembly is used to hold hand tools. It could be mounted on a small base, a desk, a workbench, a wall, a perforated wall board, in a box, etc.
3. The Tool Rack Assembly can be attached to other Tool Rack Assemblies in multiples to increase capacity and/or stability.

From the description above, a number of advantages of my tool rack assembly become evident:

(a) The rack assembly is sturdy since it is supported at each edge by two vertical support beams and at several points to a wall, post, floor, etc.

(b) The rack assembly is simple and easy to assemble and disassemble with standard tools. In its preferred embodiment, it uses only five different parts, three of which are standard fasteners, another which is a standard shelf support beam.

(c) The rack assembly will compactly store a variety of tools with long handles as well as other long items.

(d) The rack assembly can be adjusted to hold various length tools or items at various positions on a floor, against a wall or post, or on a ceiling to fully utilize available space.

(e) The rack assembly is lightweight and compact when disassembled and lightweight when assembled.

(f) The rack assembly can be mounted and adjusted quickly and easily with standard tools.

(g) The rack assembly can be galvanized to resist rust and the weather.

(h) The rack assembly will organize tools neatly.

(i) Rack assemblies can be bolted to each other vertically or horizontally to increase capacity and for stability.

The Tool Rack Assembly is assembled as in FIG. 1 with the height of the first rack pan 50 and second rack pan 52 adjusted so as to best accommodate the desired tools vertically. Similar cutouts are lined up vertically. The tool rack is stabilized by being screwed to the supporting surface using fasteners 16 through mounting holes 24 or pan support holes 32 with the pan support beams 14 resting on the floor. The top of the tool rack may be spaced off of the supporting surface with a board to give more room for the large end of rakes, hoes, push brooms and the like.

The rack is used by inserting tools with wide handles, such as spades, forks, and two handle post hole diggers, handle end down, or which ever end fits down through both aligned irregular tool cutouts 30. Rake, hoe, and broom long ends are inserted into the aligned large tool cutouts 26 or aligned small tool cutouts 28 whichever is the most convenient and placed so that the larger ends of the tools are on top and don't interfere with each other while the elongated ends rest on the floor 20. For tools and supplies 48 such as pipe, molding, extension poles, poles, dowels, tubes, test tubes, etc. which are elongated at both ends, either end can be inserted into the first rack pan 50 then the corresponding cutout in the second rack pan 52. Protective stripping 34 may be placed inside the holes to protect the items when inserting or extracting them from the holes.

In addition, the Tool Rack Assembly may be assembled as in FIGS. 10 or 11 similar to the way it was assembled above except that it would be mounted horizontally on the wall or ceiling, and the tools and supplies are mounted horizontally. A shelf can be mounted on top of the pan support beams, and items can be placed on the shelf which the tool cutouts will not hold.

Although the description above contains many specifics, these should not be construed as limiting the scope of the invention but as merely providing illustrations of some of the presently preferred embodiments of this invention. For example, the rack pan may have square, rectangular, or irregularly shaped holes to fit specific items, etc. The rack pans may be set at an angle that is not substantially horizontal or vertical, etc. There may be three or more rack pans in the assembly. In FIGS. 1 and 2, bolts in combination with nuts, screws in combination with nuts, screws in combination with captured nuts, sheet metal screws, self-tapping screws, rivets, welding, etc. are some alternative means of attaching the rack pans to the pan support beams instead of assembly bolts and washers in combination with nuts. Screws, drywall screws, lag screws, anchor bolts in combination with nuts, concrete screws, screws in combination with anchor assemblies, bolts in combination with nuts, rivets, sheet metal screws, or self-tapping screws are some examples of the fasteners which may be used to attach the tool rack assembly to the supporting surface(s). Viable vertical supporting surfaces for the tool rack are a wall or walls, the nearest stud or studs, beam or beams, post or posts, or another tool rack assembly. In FIG. 8 the base could be the floor, the top of a cart, a piece of plywood or concrete plate to stabilize the tool rack assembly, a wood or metal frame, a wood surface, etc. Strap type gussets could be replaced by triangular type gussets which are fastened at three or more points. In FIG. 9, a captured nut in combination with a bolt, a nut in combination with a screw, a sheet metal screw, a self-tapping screw, a rivet, welding, etc. are some alternate ways of attaching the pan support beams to the right angle connector in place of the assembly bolt in combination with a nut. In addition, screws, anchor bolts in combination with nuts, lag screws, screws in combination with anchor assemblies, concrete screws, bolts in combination with nuts, etc. are some examples of base fasteners which can be used to attach the right angle connectors to the base. In FIG. 10, supporting surfaces the tool rack could mounted to would be a wall or walls, studs underneath a drywall, two or more vertical studs, two or more beams or posts, two previously mounted horizontal beams, the ceiling, or studs or beams in the ceiling. In FIG. 11 the shelf could be attached to the rack structure with screws going through the mounting holes into the shelf or alternatively with screws or bolts going through the shelf and the mounting holes which are then tightened with nuts.

Thus the scope of this invention should be determined by the appended claims and their legal equivalents, rather than by the examples given.

I claim:

1. A tool rack assembly that maintains tools in a spaced array comprising:

at least two substantially planar, polygonal rack pans, namely a first rack pan and a second rack pan, with cutouts in each of the rack pans for holding tools and other items substantially perpendicular to the plane of said rack pan, with corner regions in each of the rack pans formed by the sides of the polygonal rack pan, with at least one pan assembly hole at each of the corner regions, whose centerline is substantially parallel to the plane of said rack pan;

wherein each of the rack pans is supported at each of the corner regions by at least one pan support beam, with mounting holes in the pan support beams mating with said pan assembly holes;

with means for attaching each of said pan support beams to the corresponding corner regions of each of said rack pans in the assembly;

with means for attaching said tool rack assembly to an adjacent vertical supporting surface; and further including a shelf, to provide shelf storage space, supported horizontally by two of the pan support beams, while the tool rack assembly is mounted on the vertical supporting surface in such a way that the long axes of the tools would be held substantially horizontally.

2. A tool rack comprising:

a first rack pan having a substantially planar first polygonal surface and a plurality of substantially planar side surfaces which depend angularly from respective edges of the first polygonal surface, wherein the first rack pan includes a first plurality of tool cutouts defined within the first polygonal surface and further includes a plurality of corner regions defined by adjacent ones of the plurality of side surfaces thereof;

a second rack pan having a substantially planar second polygonal surface and a plurality of substantially planar side surfaces which depend angularly from respective edges of the second polygonal surface, wherein the second rack pan includes a second plurality of tool cutouts defined within the second polygonal surface and further includes a plurality of corner regions defined by adjacent ones of the plurality of side surfaces thereof;

a plurality of pan support beams extending in directions substantially parallel with one another;

means for interconnecting each of the pan support beams with a respective one of the corner regions of the first rack pan and with a respective one of the corner regions of the second rack pan, the pan support beams and the first and second rack pans being interconnected in such a manner that the first and second rack pans are spaced apart from each other;

wherein fastening means are provided for mounting the tool rack horizontally to a vertical supporting surface in such a manner that the pan support beams extend substantially horizontally, and wherein the tool rack further includes:

a shelf, to provide shelf storage space, supported horizontally by two of the pan support beams when the tool rack is mounted horizontally on the vertical supporting surface, whereby items can be placed on the shelf which the tool cutouts will not hold.

3. The tool rack as recited in claim 2, wherein the first plurality of tool cutouts includes both large and small tool cutouts, wherein the second plurality of tool cutouts includes both large and small tool cutouts, and wherein an arrangement of the first plurality of tool cutouts on the first polygonal surface is substantially identical to an arrangement of the second plurality of tool cutouts on the second polygonal surface.

4. A surface-mounted rack comprising:

a first rack Dan having a substantially planar first polygonal surface and a plurality of substantially planar side surfaces which depend angularly from respective edges of the first polygonal surface, wherein the first rack pan includes a first plurality of tool cutouts defined within the first polygonal surface and further includes a plurality of corner regions defined by adjacent ones of the plurality of side surfaces thereof;

a second rack pan having a substantially planar second polygonal surface and a plurality of substantially planar side surfaces which depend angularly from respective edges of the second polygonal surface, wherein the second rack pan includes a second plurality of tool cutouts defined within the second polygonal surface and further includes a plurality of corner regions defined by adjacent ones of the plurality of side surfaces thereof;

a plurality of pan support beams extending in directions substantially parallel with one another;

means for interconnecting each of the pan support beams with a respective one of the corner regions of the first rack pan and with a respective one of the corner regions of the second rack pan, the pan support beams and the first and second rack pans being interconnected in such a manner that the first and second rack pans are spaced apart from each other;

a supporting surface extending in a direction substantially parallel to the directions of the plurality of pan support beams; and means for securing at least one of the pan support beams to the supporting surface;

wherein each of the Ran support beams includes an elongate angle-iron member having a plurality of spaced-apart mounting holes formed therein, wherein a plurality of mounting holes are formed in the side surfaces of the first and second rack pans at the respective corner regions thereof, and wherein the pan support beams are interconnected with the first and second rack pans by means of removable fasteners which extend through selected ones of the mounting holes in the pan support beams and corresponding ones of the mounting holes in the first and second rack pans;

wherein the means for securing at least one of the pan support beams to the supporting surface comprises a plurality of fasteners which extend through other selected ones of the mounting holes in at least one of the pan support beams and enter into the supporting surface, and wherein the first plurality of tool cutouts includes both large and small tool cutouts, wherein the second plurality of tool cutouts includes both large and small tool cutouts, and wherein an arrangement of the first plurality of tool cutouts on the first polygonal surface is substantially identical to an arrangement of the second plurality of tool cutouts on the second polygonal surface.

5. The rack of claim 4, wherein the mounting holes in each of the pan support beams are regularly spaced apart, so as to facilitate adjustment of the relative positions of the rack pans.

6. The rack of claim 4, wherein at least one pan assembly hole is provided at each of the corner regions of the rack pans, and wherein the pan support beams are interconnected with the corner regions of the rack pans by assembly bolts, wherein each of the assembly bolts passes through one of mounting holes in the pan support beams and one of the pan assembly holes at one of the corner regions of the rack pans.

7. The rack of claim 4 further including protective stripping which is placed around the large and small tool cutouts to prevent damage to tool handles or other inserted items.

8. The rack of claim 4 further including gussets which are attached near the corner regions where the pan support beams and the rack pans meet to increase stiffness of the rack assembly.

* * * * *

UNITED STATES PATENT AND TRADEMARK OFFICE

CERTIFICATE OF CORRECTION

PATENT NO. :5,810,177
DATED :September 22, 1998
INVENTOR(S) :Cabiran

It is certified that error appears in the above-identified patent and that said Letters Patent is hereby corrected as shown below:

On the title page, item [76], Inventors address should read: -- 4111 Placid Stream Ct, Houston, TX 77059 --

Signed and Sealed this

Twenty-third Day of May, 2000

*Attest:*

Q. TODD DICKINSON

*Attesting Officer*

*Director of Patents and Trademarks*